United States Patent [19]

Zambolin

[11] 3,966,037

[45] June 29, 1976

[54] EQUIPMENT FOR HANDLING DIFFERENT FORMS FOR AN ACCOUNTING MACHINE

[75] Inventor: Adriano Zambolin, Ivrea (Turin), Italy

[73] Assignee: Ing. C. Olivetti & C., S.p.A., Ivrea (Turin), Italy

[22] Filed: Nov. 20, 1974

[21] Appl. No.: 525,740

[30] Foreign Application Priority Data

Dec. 3, 1973 Italy ..... 70538/73

[52] U.S. Cl. ..... 197/133 R; 197/144

[51] Int. Cl.[2] ..... B41J 15/00

[58] Field of Search ..... 197/129, 16, 18, 133 R, 197/144

[56] References Cited

UNITED STATES PATENTS 3,653,483 4/1972 Cortona et al. ..... 197/133 R X

*Primary Examiner*—Robert W. Michell
*Assistant Examiner*—V. Millin

[57] ABSTRACT

The invention concerns a form handling device for an accounting machine wherein a continuous form, a journal form and an accounting card are independently supplied on the printing platen.

2 Claims, 2 Drawing Figures

EQUIPMENT FOR HANDLING DIFFERENT FORMS FOR AN ACCOUNTING MACHINE

BACKGROUND OF THE INVENTION

The present invention relates to an office machine, especially an accounting machine having the capability of independent feed of continuous and separate forms over a printing and supporting platen.

In modern accounting machines, it is necessary to be able to print both the data and the results of the accounting operations on various documents, such as for example, a continuous form, a basic journal, and separate forms or cards.

Various paper feed arrangements for such machines are known. In one known arrangement it is possible to feed independently only two types of forms, namely two basic journal and a continuous forms. Moreover, the aforesaid arrangement comprises a row of paper-holding rollers disposed in front of the platen immediately below the printing line, which press both the basic journal and the continuous form against the platen simultaneously. In this way, in order to be able to move one or the other of the two forms at a time, it is necessary to raise the paper-holding rollers and prearrange a device for gripping the other of the two forms, which is held stationary.

In another arrangement two types of forms are handled: a basic journal and a separate form or a card. The basic journal is passed around the platen over a certain arc and is carried along by the said platen by friction by passing under a row of rollers located in front of the platen immediately below the printing line. The separate form or the card, introduced into a suitable front insertion means, is superimposed on the basic journal and pressed by the same front rollers.

In this way, when it is desired to carry out a line-spacing operation on the basic journal, the separate form is also carried along and vice-versa.

In both these arrangements it is therefore not possible to move the separate form independently of the continuous form or the basic journal.

SUMMARY OF THE INVENTION

According to the present invention, there is provided an accounting machine having a printing and supporting platen for a first and a second continuous form, a guide and advancing device for feeding an accounting card set up over the platen, an element movable along the platen for printing on the said forms and on said accounting cards, motor means for moving the platen, an advancing device connected to said motor means for moving said first continuous form, and control means adapted to permit the simultaneous and independent movement of the first continuous form and the accounting card during the printing of the second continuous form.

The invention will be described in more detail, by way of example, with reference to the accompanying drawings.

DESCRIPTION OF THE PREFERRED EMBODIMENT

Figure 1:
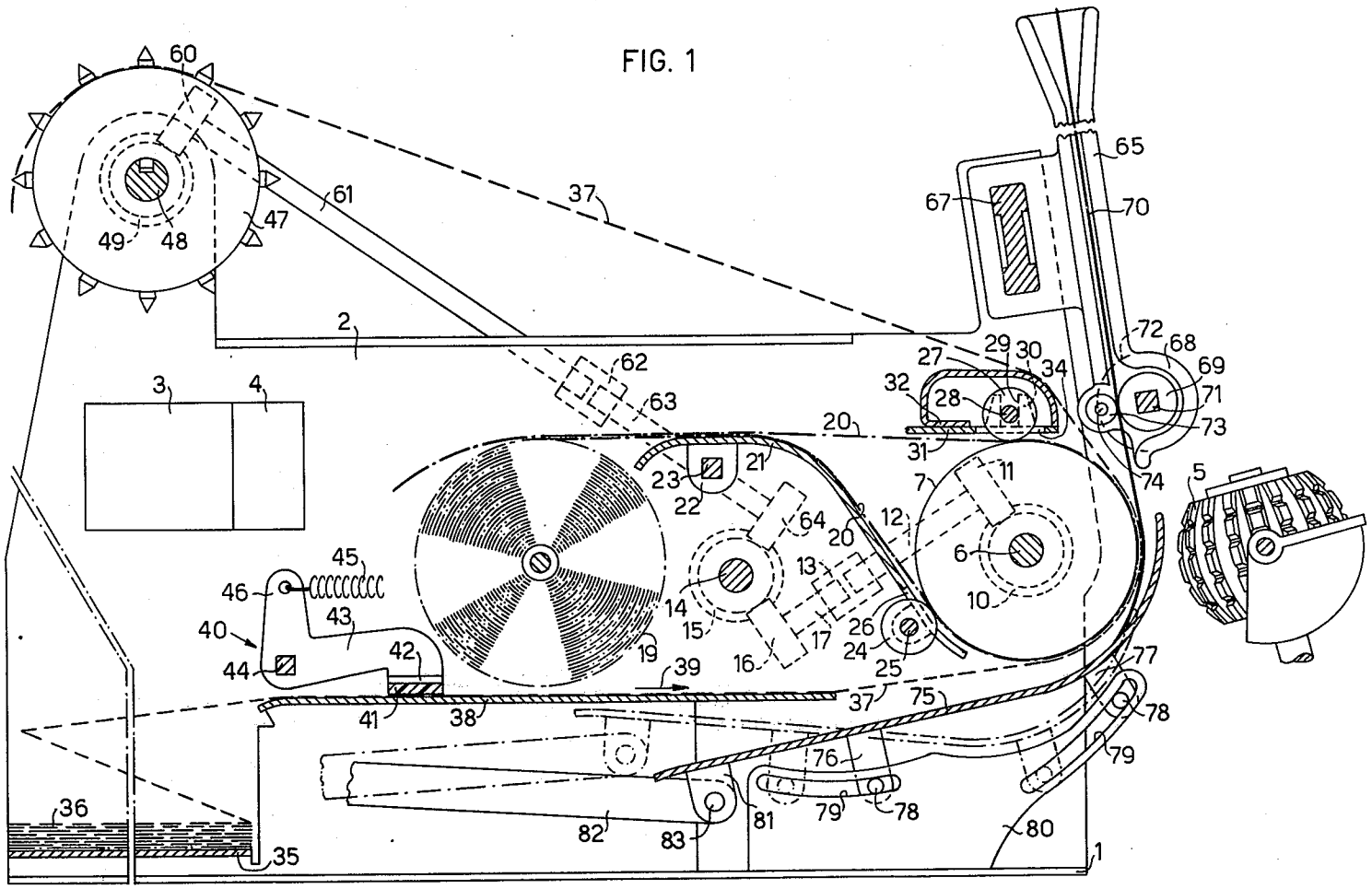
FIG. 1 is a partial longitudinal section of a machine embodying the invention.

The illustrated machine is an accounting machine. This comprises (FIG. 1) a fixed frame 1 to which are secured two side panels 2, a central unit 3 for processing the programmes which is connected to a control unit 4 for the control of actuating elements, as will be described hereinafter, a printing head 5 of well known type.

The side panels 2 are moreover interconnected by a certain number of profiled crosspieces which extend through the machine. A shaft 6 rotatable in the side panels 2 extends over the entire width of the machine and bears a platen 7. The platen 7 is formed by two adjacent parts 8 and 9 (FIG. 2) which can be rendered independent by means of a manually controlled coupling of known type. The two parts of the platen 7 will be referred to hereinafter as the main and secondary platen 8 and 9, these being the left and right parts respectively, in FIG. 2. The main platen 8 is fast with the shaft 6, while the secondary platen is mounted loosely on the shaft 6. Both the main platen and the seconardy platen can be rotated manually by means of two knobs fast with the ends of the platens.

On the shaft 6 is fixed a gear 10 (FIG. 1) meshing with a corresponding gear 11 keyed on the shaft 12 rotated by a line-spacing device of known type indicated generally by the reference 13. The line-spacing device 13 is controlled by the control unit 4 in any known manner and is actuated by a driving shaft 14 on which is keyed a gear 15 meshing with a corresponding input gear 16 keyed on a shaft 17 emerging from the line-spacing device 13.

To the rear of the platen 7, a shaft 18 fixed to the side panels 2 bears a roller 19 on which is wound a basic journal roll 20. A paper-guiding element 21 which is shaped like a curved tile is fixed by means of the lugs 22 to a prismatic shaft 23 rotatable in the side panels 2. A first row of paper-holding rollers 24 rotatable on pins 25 fast with the paper guide 21 bear against the platen 7 at the rear through windows 26 formed in the paper guide 21. A second row of paper-holding rollers 27 is arranged on top of the platen 7. Each of the rollers 27 can rotate on a pin 28 guided in guides 29 formed in lugs 30 fast with a support plate 31. The support plate 31 is disposed parallel to the platen 7 and is fixed to a bent edge 32 of a crosspiece 33 secured by its ends to the side panels 2. Under the action of a series of springs (not shown in the drawings) the rollers 27 bear against the platen 7 through windows 34 formed in the support plate 31.

A lifting device of known type and not shown in the drawings enables both the rollers 24 and the rollers 27 to be lifted away simultaneously by manual operation to permit the insertion of the journal sheet 20.

The journal sheet 20 slides over the paper-guiding element 21, passes between the rollers 24 and the platen 7, is wound around a certain arc of the platen 7 and emerges at the rear, passing below the rollers 27 at the top of the platen 7. Normally, the journal sheet occupies in width only a part of the platen 7, namely the main platen 8.

In the rear part of the machine there is formed a platform 35 adapted to support a bundle 36 of a continuous form 37 of the edge perforated type. The continuous form 37 slides on a guide surface 38 located in the rear part of the machine and extending over its entire width between the side panels 2.

At the entrance to the guide 38 in the direction in which the form 37 slides, indicated by the arrow 39, there is a braking device 40 adapted to keep the continuous form 37 taut. The device 40 is formed by a shoe 41 of soft material such as felt or soft rubber fixed to one end 42 of a lever 43 fast with a prismatic shaft 44 which can turn in the side panels 2. The shoe 41 is kept pressed against the continuous form by the action of a spring 45 attached to the other end 46 of the lever 43.

The continuous form 37, passing outside the rollers 24 and 27, is passed around the platen 7 over a certain arc. The continuous form 37 is normally passed around only a part of the platen 7, for example around the secondary platen 9; however, there is no precise limit to the width of the continuous form and it may have a width greater than the length of the secondary platen 9 and therefore be partially superimposed over the journal sheet 20 on the main platen 8.

The continuous form 37, moving away from the platen 7 in its upper portion, runs over the crosspiece 33. It then engages with its perforations a pair of toothed pulleys 47 keyed on a shaft 48. Also fixed on the shaft 48 is a gear 49 meshing with a corresponding gear 60 fixed on a shaft 61. On the shaft 61 there is arranged a clutch 62 of known type controlled by the control unit 4 for rendering the shaft 61 and a shaft 63 rigid with one another on a command from the central unit 3. On the shaft 63 is keyed a second gear 64 meshing with the gear 15.

The machine moreover comprises a device for the frontal introduction of accounting cards, or leger cards, and comprising a pair of symmetrical hopper elements 65 and 66 (FIG. 2) for guiding the lateral edges of, for example, a card 70. The elements 65 and 66 are independent of each other and can be shifted transversely in a direction parallel to the platen 7, sliding with slight friction along a guide 67 of rectangular section supported at its ends by the side panels 2 of the machine.

Each of the elements 65 and 66 (FIG. 1) encloses in its lower portion, within a guard 68, a driving roller 69 which can slide, but not rotate, on a prismatic shaft 71 extending parallel to the platen 7 and able to turn in the side panels 2 of the machine. A counter-roller 73 rotatable on a pin 74 fixed to each of the elements 65 and 66 ensures the necessary pressure against the driving roller 69 for securing reliable transport of the card 70 without the risk of dragging.

Figure 2:
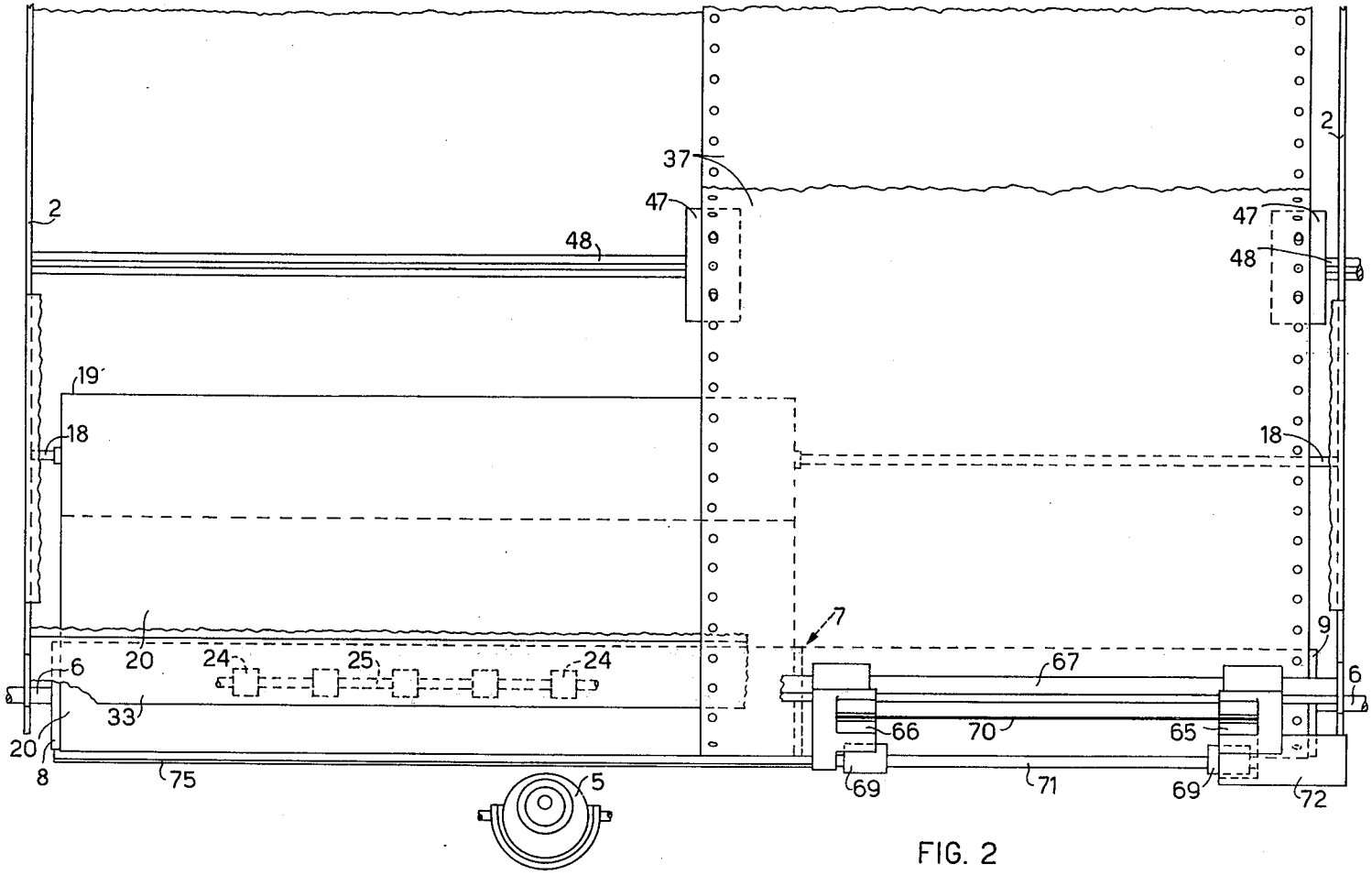
FIG. 2 is a diagrammatic front view of the machine.

The shaft 71 is connected at its left-hand end in FIG. 2 through a set of gears and a clutch known per se, which are not shown in the drawing for simplicity, to the shaft 6 for effecting line-spacing movements together with the platen 7.

To the right-hand end of the shaft 71 there is connected an auxiliary motor 72 driven by the control unit 4 on command from the central unit 3 for effecting the feed of the card introduced into the hopper elements 65 and 66 independently of the movement of the platen 7.

Below the platen 7 a substantially card-guiding cradle 75 extends over the entire length of the platen 7. The cradle 75 can adopt one or the other of two positions: in the first position, shown in solid lines in FIG. 1, it is adapted to guide a card 70 when it is introduced into the guides 65 and 66 for correct positioning thereof. The cradle 75 is brought into the second position, shown in chain-dotted lines in FIG. 1, during the printing stage.

Downwardly bent pairs of lugs 76 and 77 are formed on the cradle 75; to each lug there is fixed a pin 78 engaging in a curved slot 79 formed in a sub-frame 80 fast with the fixed frame 1 of the machine. Another pair of lugs 81 is formed in the proximity of the rear edge of the cradle 75. Levers 82 pivoted to the lugs 81 by means of the pins 83 are connected to a mechanism of known type, not shown in the drawings, for opening and closing the cradle and operating in a predetermined working cycle, for example as described in copending application Ser. No. 481,558, filed June 21, 1974.

The machine operates in the following manner: to introduce the journal sheet 20, the rollers 24 and 27 are lifted away and the sheet 20 is made to slide along the paper-guiding element 21, causing it to pass between the row of rollers 24 and the main platen 8. The two hopper elements 65 and 66 having been shifted to the right to allow access to the front zone of the crosspiece 33, the sheet 20 is bent back and is introduced between the second row of rollers 27 and the platen 7. At this point, the rollers 24 and 27 can be released and, by acting on the left-hand knob connected to the main platen 8, the movement of the sheet 20 is continued.

The continuous form 37 is caused to slide over the guide surface 38, passing below the braking shoe 41, until the front edge thereof is made to run into the cradle 75, which guides it upwardly in front of the platen 7. The front edge of the continuous form 37 is then bent back and, after shifting the hopper elements 65 and 66 to the left, the form 37 is drawn towards the rear part of the machine until the toothed pulleys 47 are caused to engage the lateral perforations of the form 37.

The hopper elements 65 and 66 having been brought back into their selected position and the distance between them having been adjusted in accordance with the width of the cards to be introduced, a first card is inserted and is fed downwardly until the first line on which it is desired to print is brought to the height of the printing line.

At this point the machine can operate on the three pieces of paper in difference sequences of the printing and line-spacing functions, as indicated by way of example hereinafter.

1. Printing on the basic journal 20 passed around the main platen 8 and simultaneous line-spacing of the continuous form 37 passed around the secondary platen;

Printing on the continuous form and simultaneous introduction and line-spacing of the card superimposed over the basic journal 20;

Printing on the card;

Ejection of the card and simultaneous line-spacing of the basic journal.

2. Printing on the basic journal on the main platen and simultaneous introduction and line-spacing of a new card superimposed over the continuous form on the secondary platen;

Ejection of the card and simultaneous line-spacing of the basic journal together with the continuous form;

Printing on the continuous form.

What I claim is:

1. In an accounting machine an equipment for independently handling a plurality of different forms comprising:

a print and supporting platen for first and second continuous forms positioned adjacent one another on said platen, a guiding means and advancing means for positioning and feeding a card over said platen in superimposed relationship with at least one of said continuous forms, said guiding means being laterally movable with respect to said platen, an element movable along said platen for printing on said forms and on said card, motor means for moving said platen, a second advancing means connected to said motor means for moving said first continuous form, and control means for allowing the similtaneous and independent movement of said first continuous form and said card during the printing on said second continuous form.

2. An equipment according to claim 1, wherein said control means comprise at least one roller disposed to the rear of said platen with respect to said element movable along said platen, said second continuous form passing between said roller and said platen to be moved by said platen, a first guide element positioned above said platen and a second guide element positioned below said platen for guiding said first continuous form and said card, respectively, outside said roller with respect to said platen.

* * * * *